US006705336B2

(12) United States Patent
Goligorski

(10) Patent No.: US 6,705,336 B2
(45) Date of Patent: Mar. 16, 2004

(54) SELF-ALIGNING STAIR COMPATIBLE WALKING AID

(76) Inventor: Piter Goligorski, 3 Savion Street, Kadima (IL)

( * ) Notice: Subject to any disclaimer, the term of this patent is extended or adjusted under 35 U.S.C. 154(b) by 37 days.

(21) Appl. No.: 10/118,000

(22) Filed: Apr. 9, 2002

(65) Prior Publication Data

US 2003/0188774 A1 Oct. 9, 2003

(51) Int. Cl.[7] ..... A61H 3/00
(52) U.S. Cl. ..... 135/67; 135/65
(58) Field of Search ..... 135/67, 65

(56) References Cited

U.S. PATENT DOCUMENTS

| | | | | |
|---|---|---|---|---|
| 1,307,058 A | | 6/1919 | McGrath | |
| 2,362,466 A | | 11/1944 | Carter | |
| 2,759,525 A | | 8/1956 | Ries | |
| 3,176,700 A | | 4/1965 | Drury | |
| 3,354,893 A | | 11/1967 | Schmerl | |
| 3,455,313 A | | 7/1969 | King | |
| 4,094,331 A | | 6/1978 | Rozsa | |
| 4,314,576 A | * | 2/1982 | McGee | 135/67 |
| 4,341,381 A | | 7/1982 | Norberg | |
| 4,411,283 A | | 10/1983 | Lucarelli | |
| 4,922,940 A | | 5/1990 | Lewy | |
| 4,941,496 A | | 7/1990 | Berning | |
| 5,271,422 A | * | 12/1993 | Sorrell et al. | 135/67 X |
| 5,347,666 A | | 9/1994 | Kippes | |
| 5,520,597 A | | 5/1996 | Tobin | |
| 5,603,517 A | | 2/1997 | Lorman | |
| 5,785,070 A | | 7/1998 | Block et al. | |
| 6,082,384 A | | 7/2000 | Cheng | |

* cited by examiner

*Primary Examiner*—Robert Canfield
(74) *Attorney, Agent, or Firm*—Mark M. Friedman

(57) ABSTRACT

The present invention is a self-aligning walking aid that is suitable for use walking on level surfaces and for ascending and descending stairs. Disclosed is a walking aid that is equally stable on level surfaces and on stairs and that does not require any structural or positional changes when transitioning from a level surface to stairs. The preferred embodiment herein discussed is configured so as to limit appropriate graspable frame members so that when lifted by the appropriate pair of handles, the walking aid will swing into alignment with the surface, level surface or stairs, on which it is being used.

7 Claims, 2 Drawing Sheets

SELF-ALIGNING STAIR COMPATIBLE WALKING AID

FIELD AND BACKGROUND OF THE INVENTION

The present invention relates to walking assistance devices and, in particular, it concerns a walking aid that is suitable for use walking on level surfaces and for use ascending and descending stairs that is self-aligning for the surface upon which it is being used.

Walking assistance devices include a group of devices generally referred to as canes and a group generally referred to as walkers. A generally accepted broad definition of a walker is a framework used to assist someone with walking. Within this definition are found device offering varied degrees of support in an array of configurations.

Of the devices offering the most support, U.S. Pat. No. 1,307,058 to McGrath, discloses a device that includes a seat and crutch type shoulder supports. U.S. Pat. No. 4,341,381 to Norberg is representative of crutch style shoulder support type walkers. Since these type of walkers are based on a basic crutch style, they also include a pair of handles that are generally located below the shoulder supports at a height convenient for grasping with the hands. These handles may also be used for assisting the user when sitting down or getting up from a chair.

The group of walkers offering moderate assistance is typified by a three-sided frame with handles placed on two opposite sides. The user lifts the frame by the handles, moves it forward and then takes a step forward. The basic stability is determined in part by variables such as the spacing between the front and back legs, and if or how much the frame encloses the user. Within this group, there are several variations of walkers adapted for use on stairs. For these walkers, the list of stability variables must include the degree of bending or stooping necessary to reposition the walker on the next step, especially in a descending situation.

Taking in to account the wide range of needs of the population of walker users, the stair adaptable walkers include a wide range of support and stability assistance to suit those needs. U.S. Pat. No. 4,941,496 to Berning discloses a walker that may be suited for use by those persons needed the least amount of stability assistance. The devices of U.S. Pat. No. 3,176,700 to Drury, U.S. Pat. No. 3,455,313, to King and U.S. Pat. No. 4,411,283 to Lucarelli all offer more support and stability than the Berning device. They all also suffer from the need to make mechanical adjustments when changing from a level surface to an incline or stairs. These adjustments are in predetermined increments and the legs are then locked in place, thereby being problematic on not standard or uneven steps. While the adjustments for each device seem relatively easy, they may too difficult for the user to perform in the field, as it were. The device of Drury must be turned around and then adjusted before ascending the stairs. The device of U.S. Pat. No. 4,094,331 to Rozsa must be completely flipped over when changing from a level surface to stairs. With these types of device, manipulation may constitute lifting that is beyond the abilities of some populations. Another drawback to these devices is the span between the front and back legs. While this span may be adequate for use on level surfaces and inclines, in use on stairs, they are limited to a span of one step. This base of stability on stairs may be inadequate for many users. Thus, any of the above mentions devices may be unsuitable for use on stairs by persons for whom the device may other wise be well suited.

U.S. Pat. No. 4,922,940 to Lewy discloses a walker specifically adapted for traversing stairs. This device represents the opposite end of the spectrum, as it were, from the device of Berning. While the Lewy's device is stable and requires no adjustments to negotiate stairs or inclines, it does so at the expense of size, which may impact maneuverability. Furthermore, the stair handle of Lewy are located well forward of the center of gravity of the device and to lift all four legs up and over the next steps may require strength beyond a population of users for whom the stability of the Lewy device is appropriate on stairs but the device is more than they can handle in such a situation.

There is therefore a need for a walker that offers stability on level surfaces, inclines and stairs, and that requires no mechanical adjustments and is self-aligning when changing to and from stair or incline use.

SUMMARY OF THE INVENTION

The present invention is a walking aid that is suitable for use walking on level surfaces and for use ascending and descending stairs that is self-aligning for the surface upon which it is being used.

According to the teachings of the present invention there is provided, a stair compatible walking aid for use on level surfaces and stairs, comprising: an open ended framework; the framework being supported at a closed end by at least two spaced apart front legs; the framework being further supported at the open end by at least two spaced apart rear legs, the front legs and the rear legs being spaced apart by a distance that spans a plurality of steps when the walking aid is deployed on stairs of standard rise and run; and the framework including a pair of parallel spaced apart side top-rails configured such that both the side top-rails include a first handle-portion that is substantially horizontal when the walking aid is deployed on a level surface, the first handle-portion being spaced above the level surface at a first height, both the side top-rails further including a second handle-portion that is a downwardly sloping continuation of the side top-rails; whereby, the first handle-portions are distal to the closed end of the framework and the second handle-portions are proximal to the closed end of the framework, the first handle-portions including a first pair of handles located such that as the walking aid is lifted by grasping the first pair of handles the front legs and the rear legs come into alignment for deployment on a level surface, the second handle-portion including a second pair of handles located such that as the walking aid is lifted by grasping the second pair of handles the front legs and the rear legs come into alignment for deployment on stairs.

According to a further teaching of the present invention, the downward slope of the second handle-portion is such that the second handle-portion is rendered substantially horizontal when the walking aid is deployed on stairs of standard rise and run.

According to a further teaching of the present invention, the second handle-portion is spaced above one step of the stairs at the first height, the one step being located substantially midway in the span between the front legs and the rear legs.

According to a further teaching of the present invention, all of the legs are each of a length so as to provide clearance for the framework when deployed on stairs.

According to a further teaching of the present invention, the front legs and the rear legs are implemented as four legs deployed substantially at four corners of a substantially rectangular bottom sub-frame of the framework, the bottom sub-frame being substantially open at one end.

According to a further teaching of the present invention, the framework includes a first pair of parallel upright frame members being connected to the bottom sub-frame on opposite corners of the open end, and each deployed so as to support one of the side top-rails at a distal end of the first handle-portion, the first pair of frame members being deployed such that top points of connection to the side top-rails are proximal to bottom points of connection to the bottom sub-frame so as to limit the first handle portion to a span of a length equal to the length of one of the first pair of handles.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a walking aid that is suitable for use walking on level surfaces and for use ascending and descending stairs that is self-aligning for the surface upon which it is being used.

The principles and operation of a self-aligning walking aid suitable for use walking on level surfaces and ascending and descending stairs, according to the present invention may be better understood with reference to the drawings and the accompanying description.

By way of introduction, an intention of the present invention is to provide a walking aid that is equally stable on level surfaces and on stairs and that does not require any structural or positional changes when transitioning from a level surface to stairs, and that is substantially self aligning with respect to the surface on which it is being used. To this end, the preferred embodiment herein discussed is configured so as to limit appropriate graspable frame members so that the center of gravity of the walking aid causes it to swing from an attitude where the front and back legs are in alignment with one surface, for example a level surface, to an attitude where the front and back legs are in alignment with another surface, for example stairs.

Figure 1:
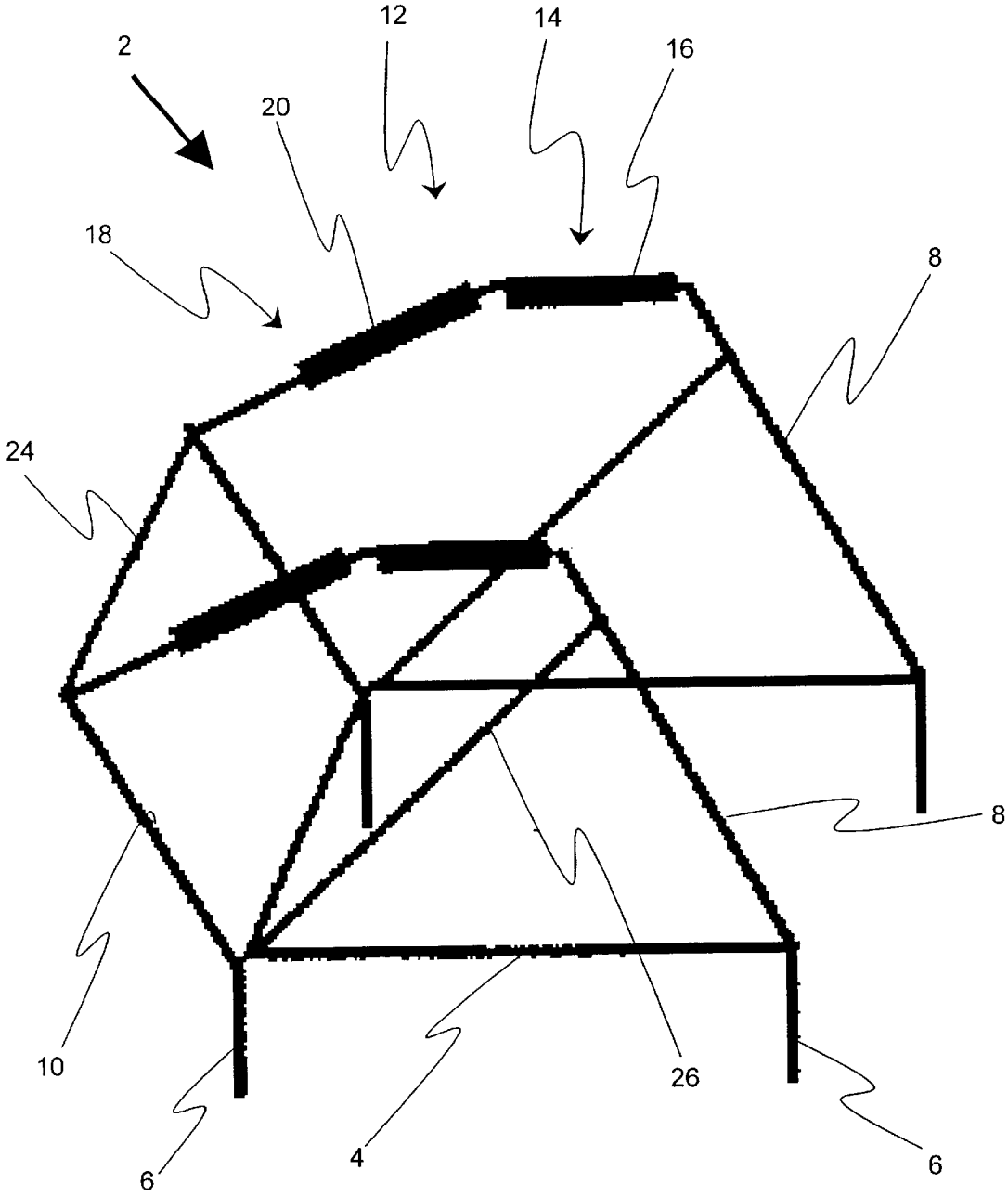
FIG. 1 is perspective view of a preferred embodiment of a stair compatible walking aid constructed and operative according to the teachings of the present invention, deployed on a level surface.
Figure 2:
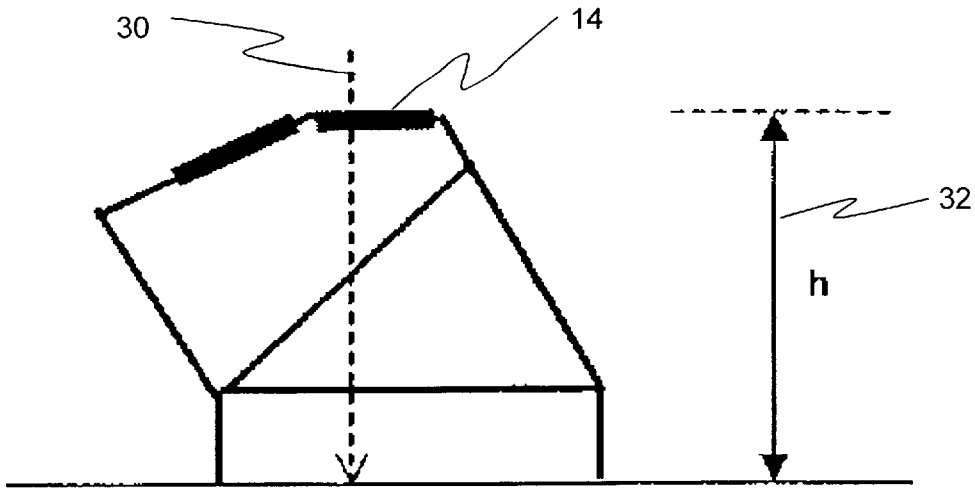
FIG. 2 is a side elevation of the walking aid of FIG. 1 deployed on a level surface.

Referring now to the drawings, FIG. 1 shows a preferred embodiment of the present invention. The open ended framework, generally designated 2, includes a three sided bottom sub-frame 4 supported by four legs 6. Two rear upright frame members 8 and two front upright frame members 10, extend upward from the bottom sub-frame and support the top side-rails 12, which are connected at the closed end by a substantially horizontal cross-member 24. The framework is configured in the non-limiting example illustrated here, such that the rear upright frame members extend from the bottom sub-frame at an angle toward the closed, forward, end of the framework. The each of the top side-rails 12 extends horizontally from the points of connection with the rear frame members toward the closed end of the framework. The distal portions 14 of the top side-rails are configured to be substantially horizontal when the walking aid is deployed on a level surface. Because of the forward angle of the rear upright frame members, the distal portion 14 of the top side-rail is limited to an expanse that aligns with the center of gravity 30 of the walking aid, so that when the level surface handles 16 are grasped and the walking aid is lifted, the front and back legs come into alignment with the level surface, as shown in FIG. 2. As used herein, the terms "distal" and "proximal" refer to placement in relation to the closed end of the framework.

The proximal portions 18 of the top side-rails proceed at a downward angle toward the points of connection to the front upright support members 10, which are angled from the vertical so as to be substantially parallel to the rear upright frame members. It should be noted that additional frame members may be included in the framework for structural support purposes, as illustrated here, by non-limiting example, by frame members 26.

Looking again at FIG. 2, the framework is configured so that the distal portions of the top side-rails are a predetermined height 32 above the level surface.

Figure 3:
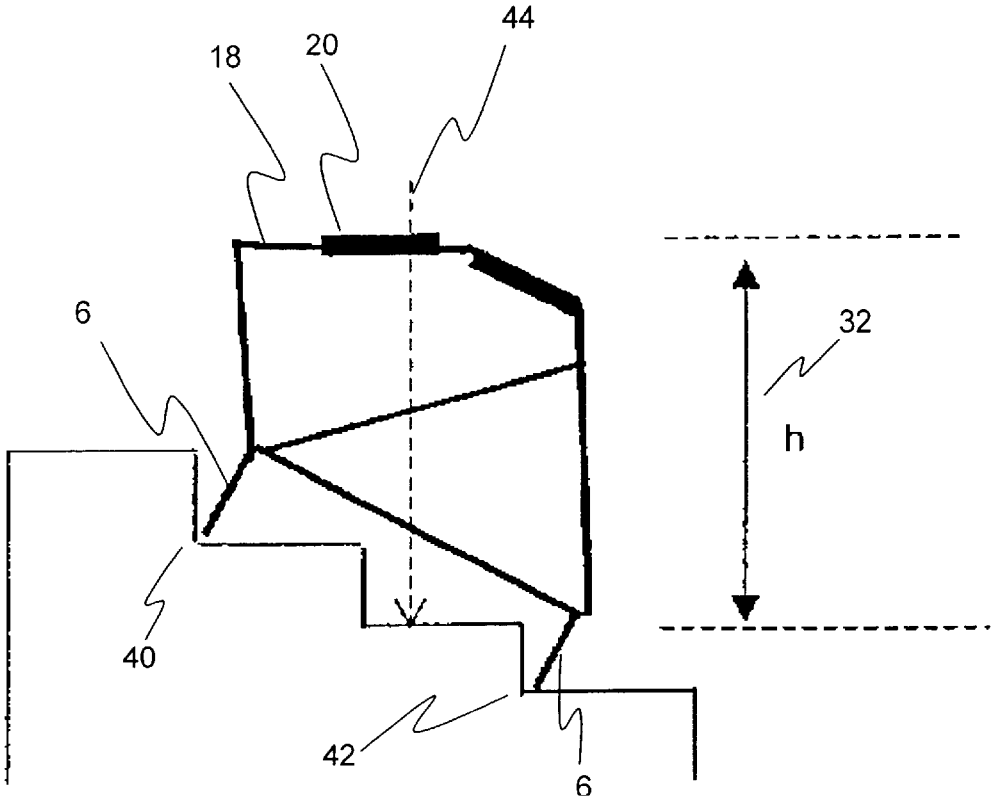
FIG. 3 is a side elevation of the walking aid of FIG. 1 deployed on stairs.

In FIG. 3, the walking aid is deployed on stairs of what is commonly referred to in the building trades "standard rise and run." This term as used here in, and commonly, refers to a rise of 7 inches and a run of 10.5 inches (see Appendix A). The distance between the front legs and the back legs is such that the walking aid spans a plurality of steps. In the case of use on stairs of standard rise and run, as illustrated in this non-limiting example, the distance between the front and back legs is 25.25 inches, thus the walking aid spans two steps, and both the front and the back legs 6 are lodged in the back corners 40 and 42 of the steps. It should be noted that this example of both the front and back legs being lodged in the back corners of both of the steps on which the walking aid is deployed is an example of an optimal deployment. The practicality of allowing for variances in stairs and construction tolerances results in a walking aid with a distance between the front and back legs of not less than 26 inches. Thus, the deployment of the front legs is in the back corner and the back legs are deployed well onto the step upon which they are resting, or conversely, the back legs lodged in the back corner and the front legs deployed well on the step upon which they are resting. This placement of the legs in the back corners of the steps adds to the stability of the walking aid when used on stairs. Further, as seen here, the proximal portion 18 of the top side-rail is substantially vertical at the same height 32 above one of the steps as the distal portion is above the level surface (FIG. 2). This is the step to which the user will be stepping with his/her next step. The stair handles 20 are positioned so that when the walking aid is lifted by these handles the center of gravity 44 of the walking aid causes the front and back legs to come into alignment for deployment on stairs. The front upright frame members being substantially vertical allows for stable use of the walking aid while descending stairs, while maintaining the compact profile of the walking aid.

In use, the user grasps the level surface handles 14, moves the walking aid forward then takes a step forward. When coming to stairs, the user simply grasps the stair handles 20, lifts the walking aid up, the walking aid self aligns for deployment on the stairs, as shown in FIG. 3, and the user takes a step up. The walking aid is then lifted and moved up a step and the user takes another step up. At the top of the stairs the user simply grasps the level surface handles 14, the walking aid swings into alignment for the deployment on a level surface and the user continues walking forward.

It will be obvious to one skilled in the art that when the walking aid is deployed on stairs of non-standard rise and run, the framework will span a number of steps based on the particular rise and run, and that only the front legs, or the back legs, may be placed in the back corner of the step on which they are placed. Further, the overall dimensions of the framework may be adjusted to accommodate any number of steps within the span between the front and back legs.

It will be appreciated that the above descriptions are intended only to serve as examples, and that many other embodiments are possible within the spirit and the scope of the present invention.

APPENDIX A

The table below was taken from the OSHA standards for "Fixed Industrial Stairs, 1910.24" as stated at the OSHA web site (www.osha-slc.gov/OshStd_data/ 1910_0024.html). This data is consistent with building codes in most states.

Using the data provided to calculate the distance from the back corner of one step, to the back corner of the next step, is fairly consistent, with a variance of less than half an inch (.41 inches), across the range of steps of "standard rise and run." This is relevant with regard to the walking aid of the present invention and the distance between the back corners of the steps, as discussed in Figure 3, thus the use of the phrase "stairs of standard rise and run" throughout this document.

Table D-1

| Angle to horizontal | Rise (in inches) | Tread run (in inches) |
|---|---|---|
| 30 deg. 35'..... | 6 1/2 | 11 |
| 32 deg. 08'..... | 6 3/4 | 10 3/4 |
| 33 deg. 41'..... | 7 | 10 1/2 |
| 35 deg. 16'..... | 7 1/4 | 10 1/4 |
| 36 deg. 52'..... | 7 1/2 | 10 |
| 38 deg. 29'..... | 7 3/4 | 9 3/4 |
| 40 deg. 08'..... | 8 | 9 1/2 |
| 41 deg. 44'..... | 8 1/4 | 9 1/4 |
| 43 deg. 22'..... | 8 1/2 | 9 |
| 45 deg. 00'..... | 8 3/4 | 8 3/4 |
| 46 deg. 38'..... | 9 | 8 1/2 |
| 48 deg. 16'..... | 9 1/4 | 8 1/4 |
| 49 deg. 54'..... | 9 1/2 | 8 |

What is claimed is:

1. A stair compatible walking aid for use on level surfaces and stairs, comprising:

a. an open ended framework;

b. said framework being supported at a closed end by at least two spaced apart front legs;

c. said framework being further supported at said open end by at least two spaced apart rear legs, said front legs and said rear legs being spaced apart by a distance that spans a plurality of steps when the walking aid is deployed on stairs of standard rise and run; and d. said framework including a pair of parallel spaced apart side top-rails configured such that both said side top-rails include a first handle-portion that is substantially horizontal when the walking aid is deployed on a level surface, said first handle-portion being spaced above said level surface at a first height, both said side top-rails further including a second handle-portion that is a downwardly sloping continuation of said side top-rails such that an angle between said first handle-portion and said second handle portion is not more than 35°;

whereby, said first handle-portions are distal to said closed end of said framework and said second handle-portions are proximal to said closed end of said framework, said first handle-portions including a first pair of handles located such that as the walking aid is lifted by grasping said first pair of handles said front legs and said rear legs come into alignment for deployment on a level surface, said second handle-portion including a second pair of handles located such that as the walking aid is lifted by grasping said second pair of handles said front legs and said rear legs come into alignment for deployment on stairs.

2. The walking aid of claim 1, wherein said downward slope of said second handle-portion is such that said second handle-portion is rendered substantially horizontal when the walking aid is deployed on stairs of standard rise and run.

3. The walking aid of claim 2, wherein said second handle-portion is spaced above one step of said stairs at said first height, said one step being located substantially midway in the span between said front legs and said rear legs.

4. The walking aid of claim 1, wherein all of said legs are each of a length so as to provide clearance for said framework when deployed on stairs.

5. The walking aid of claim 1, wherein said front legs and said rear legs are implemented as four legs deployed substantially at four corners of a substantially rectangular bottom sub-frame of said framework, said bottom sub-frame being substantially open at one end.

6. A stair compatible walking aid for use on level surfaces and stairs, comprising:

a. an open ended framework;

b. said framework being supported at a closed end by at least two spaced apart front legs;

c. said framework being further supported at said open end by at least two spaced apart rear legs, said front legs and said rear legs being spaced apart by a distance that spans a plurality of steps when the walking aid is deployed on stairs of standard rise and run; and d. said framework including a pair of parallel spaced apart side top-rails configured such that both said side top-rails include a first handle-portion that is substantially horizontal when the walking aid is deployed on a level surface, said first handle-portion being spaced above said level surface at a first height, both said side top-rails further including a second handle-portion that is a downwardly sloping continuation of said side top-rails configured such that said second handle-portion is rendered substantially horizontal when the walking aid is deployed on stairs of standard rise and run;

whereby, said first handle-portions are distal to said closed end of said framework and said second handle-portions are proximal to said closed end of said framework, said first handle-portions including a first pair of handles located such that as the walking aid is lifted by grasping said first pair of handles said front legs and said rear legs come into alignment for deployment on a level surface, said second handle-portion including a second pair of handles located such that as the walking aid is lifted by grasping said second pair of handles said front legs and said rear legs come into alignment for deployment on stairs.

7. A stair compatible walking aid for use on level surfaces and stairs, comprising:

a. an open ended framework;

b. said framework being supported at a closed end by at least two spaced apart front legs;

c. said framework being further supported at said open end by at least two spaced apart rear legs, said front legs and said rear legs being spaced apart by a distance that spans a plurality of steps when the walking aid is deployed on stairs of standard rise and run; and d. said framework including a pair of parallel spaced apart side top-rails configured such that both said side top-rails include a first handle-portion that is substantially horizontal when the walking aid is deployed on a level surface, said first handle-portion being spaced above said level surface at a first height, both said side top-rails further including a second handle-portion that is a downwardly sloping continuation of said side top-rails configured such that said second handle-portion is rendered substantially horizontal when the walking aid is deployed on stairs of standard rise and run, and said second handle-portion is spaced above one step of the stairs at said first height, said one step being located substantially midway in the span between said front legs and said rear legs;

whereby, said first handle-portions are distal to said closed end of said framework and said second handle-portions are proximal to said closed end of said framework, said first handle-portions including a first pair of handles located such that as the walking aid is lifted by grasping said first pair of handles said front legs and said rear legs come into alignment for deployment on a level surface, said second handle-portion including a second pair of handles located such that as the walking aid is lifted by grasping said second pair of handles said front legs and said rear legs come into alignment for deployment on stairs.

* * * * *